US006922156B2

(12) United States Patent
Kavner

(10) Patent No.: US 6,922,156 B2
(45) Date of Patent: Jul. 26, 2005

(54) VEHICLE TRIP DETERMINATION SYSTEM AND METHOD

(75) Inventor: Douglas M. Kavner, Orange, CA (US)

(73) Assignee: Raytheon Company, Waltham, MA (US)

( * ) Notice: Subject to any disclaimer, the term of this patent is extended or adjusted under 35 U.S.C. 154(b) by 337 days.

(21) Appl. No.: 10/058,591

(22) Filed: Jan. 28, 2002

(65) Prior Publication Data

US 2002/0140579 A1 Oct. 3, 2002

Related U.S. Application Data

(60) Provisional application No. 60/264,498, filed on Jan. 26, 2001, and provisional application No. 60/264,424, filed on Jan. 26, 2001.

(51) Int. Cl.[7] ..... G08G 1/123

(52) U.S. Cl. ..... 340/988; 340/919; 340/917; 340/929

(58) Field of Search ..... 340/988, 928, 340/933, 929, 931, 936, 937, 919, 917

(56) References Cited

U.S. PATENT DOCUMENTS

| | | | | | |
|---|---|---|---|---|---|
| 4,555,618 | A | * | 11/1985 | Riskin | 235/384 |
| 4,963,723 | A | | 10/1990 | Masada | |
| 4,979,221 | A | | 12/1990 | Perryman et al. | |
| 5,227,803 | A | | 7/1993 | O'Connor et al. | |
| 5,253,162 | A | * | 10/1993 | Hassett | 340/928 |
| 5,289,183 | A | | 2/1994 | Hassett et al. | |
| 5,310,999 | A | | 5/1994 | Claus et al. | |
| 5,422,473 | A | | 6/1995 | Kamata | |
| 5,485,520 | A | | 1/1996 | Chaum et al. | |
| 5,651,075 | A | | 7/1997 | Frazier et al. | |
| 5,675,494 | A | * | 10/1997 | Sakurai et al. | 705/417 |
| 5,696,502 | A | | 12/1997 | Busch et al. | |
| 5,696,503 | A | | 12/1997 | Nasburg | |
| 5,801,943 | A | | 9/1998 | Nasburg | |
| 5,948,038 | A | | 9/1999 | Daly et al. | |
| 6,042,008 | A | | 3/2000 | Ando et al. | |
| 6,078,895 | A | * | 6/2000 | Ryu et al. | 340/933 |
| 6,109,525 | A | * | 8/2000 | Blomqvist et al. | 235/384 |
| 6,111,523 | A | | 8/2000 | Mee | |
| 6,140,941 | A | * | 10/2000 | Dwyer et al. | 340/928 |
| 6,177,885 | B1 | | 1/2001 | Weil et al. | |
| 6,449,555 | B1 | * | 9/2002 | Ohba et al. | 340/937 |
| 2002/0000920 | A1 | | 1/2002 | Kavner | |
| 2002/0140577 | A1 | | 10/2002 | Kavner | |

FOREIGN PATENT DOCUMENTS

| | | |
|---|---|---|
| EP | 0632410 | 1/1995 |
| EP | 0 632 410 A2 | 1/1995 |
| EP | 0 767 446 | 4/1997 |
| EP | 0779600 | 6/1997 |
| EP | 0 903 916 | 3/1999 |
| GB | 2154832 | 9/1985 |
| WO | 9933027 | 7/1999 |
| WO | 0169569 | 9/2001 |

OTHER PUBLICATIONS

D. Rittich et al., "Perspektiven Der Verkehrsleittechnik", Nachrichtentechnische Berichte, ANT Nachrichtentechnik Gmb. Backnang, DE, No. 9,Apr. 9, 1992, pp. 111–119.

(Continued)

*Primary Examiner*—Jeffery Hofsass
*Assistant Examiner*—Daniel Previl
(74) *Attorney, Agent, or Firm*—Daly, Crowley, Mofford & Durkee, LLP

(57) ABSTRACT

A method for determining a vehicle trip on a roadway includes providing a plurality of vehicle detections from a plurality of gateways, determining a maximum travel time between corresponding pairs of the plurality of gateways, correlating corresponding pairs of the plurality of vehicle detections by determining that a travel time between each of the gateways of each of the corresponding pairs of detections is less than a corresponding maximum travel time, determining a plurality of chainable detections, and determining the boundaries of the trip.

38 Claims, 6 Drawing Sheets

OTHER PUBLICATIONS

Patent Abstracts of Japan, Publication No. 2000 057483, Published on Feb. 25, 2000 Nippon Telegr. & AMP; Teleph Corp.

Patent Abstracts of Japan, Publication No. 07254099, Published on Oct. 3, 1995, Toshiba Corp.

Pulnix America Inc., data sheets, Video Image processing (VIP) Computer, Dec. 16, 1998.

Pulnix America Inc., data sheets, Video Image Capture (VIC) Subsystem, Dec. 16, 1998.

Pulnix America Inc., data sheets, Vehicle Imaging System (VIS) Subsystem, Apr. 15, 1999.

International Search Report of PCT Application No. PCT/US02/02472 mailed Dec. 9, 2002.

* cited by examiner

= transaction limiting advance of $\dot{t}$ or $\ddot{t}$

= extrapolation region

= firm trip

= potential trip

= vehicle transaction

VEHICLE TRIP DETERMINATION SYSTEM AND METHOD

CROSS-REFERENCE TO RELATED APPLICATIONS

This application claims the benefit of U.S. Provisional Application No. 60/264,498 filed on Jan. 26, 2001, and U.S. Provisional Application No. 60/264,424 filed on Jan. 26, 2001, each of which is incorporated herein in its entirety.

FIELD OF THE INVENTION

This invention relates generally to toll collection systems and more particularly to a system and method to determine vehicle trips in a tolling system.

BACKGROUND OF THE INVENTION

In electronic or automatic toll collection applications, it is desirable to correctly identify a vehicle traveling on the roadway and to determine the path of the vehicle on the toll roadway for billing purposes. Furthermore, vehicles are identified by vehicle transponders which are read by automatic vehicle identification (AVI) readers located along a roadway or at toll collection stations. Automatic toll collection systems also identify vehicles by reading license plate numbers. License plate reading systems include cameras which capture license plate images that are subsequently read by an automatic optical character recognition (OCR) processors and manually read by human operators to provide license plate numbers. Both the transponder system and license plate reading system are subject to errors which degrade performance and reduce revenues of the toll collection system.

In an open ticket toll collection system (also referred to as an open-road, no lane barrier system), toll gateways are placed along the mainline roadways as opposed to a closed ticket system which includes toll gateways at the roadway entry and exit points. Open ticket systems are desirable due to reduced infrastructure requirements, but it is difficult to determine when vehicles actually enter and exit the roadway since there is no positive confirmation of these events. As a result, it is not possible to bill vehicles on a trip basis or develop a traffic model of how vehicles are actually using the roadways.

One conventional solution has been to bill a set amount for each toll gateway crossed. While simple, this approach cannot support trip based billing which is desirable for many reasons including: (1) support for minimum and/or maximum trip charges; (2) simplified statements; (3) accurate traffic models; and (4) reducing losses from non-functional tolling equipment.

Conventional systems use a combination of electronic and manual toll collection and the system operators have chosen to treat the electronic portion merely as a convenience, (e.g. 'fast lanes" or "express lanes" to allow drivers to bypass manual toll booths). These conventional systems automate existing manual systems and keep the same rules that apply to the manual system rather than attempt true trip based billing.

In complicated automatic toll collection systems, there is a high probability that a system data error will produce incorrect billing information. The automatic toll collection system is also subject to toll evasion by several means including stolen or improperly used transponders and license plates. In typical automatic toll systems, incorrect identification of a vehicle or non-identification of a vehicle is costly.

In conventional systems the error rate ranges from two percent to ten percent. An error in a license plate reading results in lost revenue, increased customer support expenses and customer dissatisfaction when a customer is incorrectly billed. When a vehicle identification cannot be made either by a transponder or license plate reading, the toll revenue is not collected.

It would, therefore, be desirable to provide a reliable trip determination system in an open ticket toll collection system and combined open ticket and closed ticket system to support trip based billing. It would be further desirable to provide a method to determine system malfunctions and to identify possible toll evaders.

SUMMARY OF THE INVENTION

In accordance with one aspect of the present invention, a toll collection system includes a plurality of gateways and a trip determination processor. The trip determination processor includes a transaction processor, a vehicle detection correlation processor coupled to the transaction processor, a transaction filter processor coupled to the vehicle detection correlation processor, an end of a trip detection processor coupled to the transaction filter processor, a start of a trip detection processor coupled to the transaction filter processor, and a trip formation processor coupled to the transaction filter processor, the end of a trip detection processor, and the start of a trip detection processor. With such an arrangement, the system automatically determines vehicle trips, reduces the number of manual reads, and supports trip based billing, in an open ticket toll collection system, an open ticket tolling enforcement system, a complex closed ticket system involving a network of roads or a combination open/closed ticket system.

In accordance with a further aspect of the present invention, a method is provided for determining a vehicle trip on a roadway including providing a plurality of vehicle detections from a plurality of gateways, determining a maximum travel time between corresponding pairs of the plurality of gateways, correlating corresponding pairs of the plurality of vehicle detections by determining that a travel time between each of the gateways of each of the corresponding pairs of detections is less than a corresponding maximum travel time, determining a plurality of chainable detections, and determining the boundaries of the trip. Such a technique reliably determines trips in an open ticket toll collection system and combined open ticket and closed ticket system, supports trip based billing and provides a method to determine system malfunctions, and to identify possible toll evaders. Such a technique further determines when it would be premature to declare a trip complete. Thus, once a decision is made to declare that a vehicle has completed a billable trip, there is a relatively small probability of an error in that decision. This final trip decision simplifies the billing and accounting processes.

In accordance with a still further aspect of the present invention, a method is provided to determine a vehicle trip having a plurality of gateways disposed according to a roadway topology. The method includes providing a model of the topology including gateway connectivity, a plurality of minimum travel times between pairs of gateways, and a plurality of incident free maximum travel times between pairs of gateways, providing a plurality of vehicle detections, providing a set of rules for applying the model, correlating the plurality of vehicle detections by applying the rules to the plurality of vehicle detections, and determining a plurality of chainable vehicle detections forming the trip. Such a technique is flexible enough to apply to most roadway configurations and can be used to determine complete trips in a network of toll roads where vehicles can make loop trips or have multiple routes to a destination.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
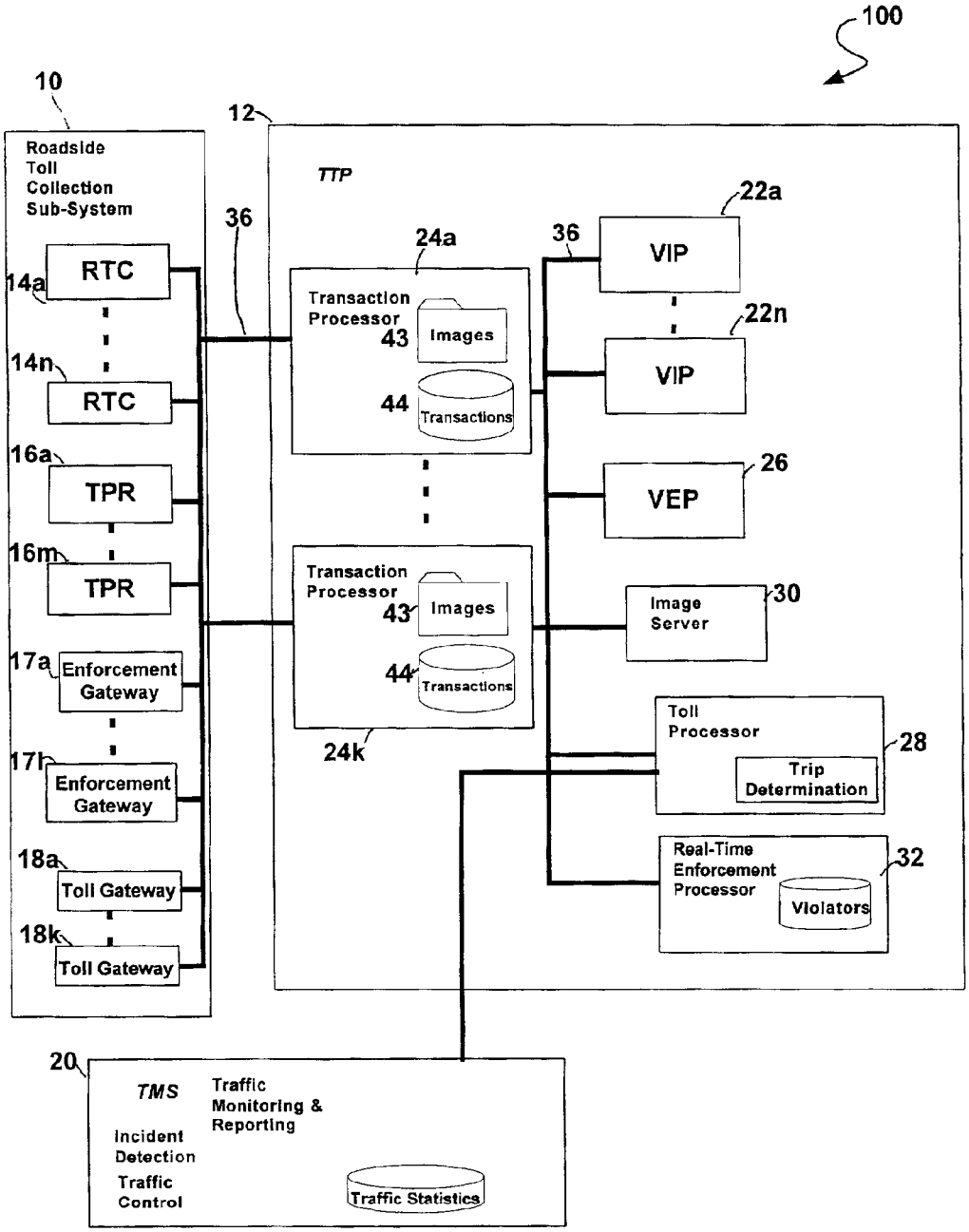
FIG. 1 is a schematic diagram of an automatic roadway toll collection and management system including a trip determination subsystem according to the invention.

Before providing a detailed description of the invention, it may be helpful to define some of the terms used in the description. Video Image Processing includes but is not limited to locating a license plate within an image automatically, providing a sub-image which includes the license plate number, reading a license plate number using optical character recognition (OCR) techniques, matching license plate images using correlation techniques and other image processing methods. Video Exception Processing includes locating a license plate image, providing a sub-image and manually reading the license plate number from the sub-image. A registered plate (also referred to as a transponder registered license plate number) is a license plate associated with a transponder and registered to a customer account for toll billing purposes. A video user is a customer who does not have a registered transponder. In one embodiment, an unregistered user is considered a "video user" by default.

A Non-Final Plate Read is a processing condition indicating that a plate number has been read but may be subject to being re-read manually if it is later determined that there is a relatively high probability the license plate number previously read is in error. A Final Plate Read is a processing condition indicating that a plate has been read with sufficient confidence so no further re-reads of the plate image are required.

A transaction is a record of a vehicle crossing a toll gateway or other roadside device on the roadway where a record of the vehicle crossing the point can be recorded. A detection is provided by a trip processor processing a transaction or group of transactions to filter out duplicate transactions and certain ambiguous transactions.

A Trip is a complete journey on the Toll Road by an individual vehicle. A single gateway trip is a trip which includes a single detection. A time marker t-dot ($\dot{t}$) is defined as the time of oldest detection in the system that is in an initial processing state. A time marker t-double-dot ($\ddot{t}$) is defined as the time of the oldest detection in the system that has transitioned out of the initial processing state, but which is awaiting verification. A license plate number (also referred to as license plate characters) initially associated with a transaction for use in trip chaining may be identified as suspect as a result of the trip chaining processing, particularly for single gateway trips. Those license plate characters may be altered through manual review using manual reads at a later point in time. This manual review of the single gateway trip is referred to as single gateway verification. Verification of license plate numbers includes confirming by manually reading a license plate image that an OCR reading or previous manual reading is correct.

When required, an AVI reading can be confirmed by processing the plate image using the VIP or by manually reading the plate image. Now referring to FIG. 1, an automatic roadway toll collection and management system 100 for a toll roadway includes a roadside toll collection subsystem 10 and a transaction and toll processing subsystem (TTP) 12 which are interconnected, for example, via a network 36. The roadside toll collection subsystem 10 includes a plurality of roadside toll collectors (RTC) 14*a*–14*n* (generally referred to as RTC 14). Each RTC 14 is coupled to a plurality of traffic probe readers (TPR) 16*a*–16*m* (generally referred to as TPR 16), a plurality of enforcement gateways 17*a*–17*l* (generally referred to as enforcement gateways 17), and a plurality of toll gateways (TG) 18*a*–18*k* (generally referred to as TGs 18) which are interconnected via the network 36. The enforcement gateways 17 and TGs 18 are collectively referred to as gateways. The TPRs 16, enforcement gateways 17, and TGs 18 are collectively referred to as roadside devices. The transaction and toll processing (TTP) subsystem 12 includes a plurality of transaction processors 24*a*–24*k* (generally referred to as transaction processor (TP) 24) coupled to an image server 30, at least one electronic plate reading video image processor (VIP) 22*a*, a manual plate reading processor 26 (also referred to as a video exception processor (VEP) 26), a toll processor 28, and a real-time enforcement processor 32. Each TP 24 processes a plurality of transactions 44 and associated images 43. The toll processor 28 includes a trip determination processor 40. The system 100 optionally includes additional VIPs (shown as VIP 22*n*). The system 100 further includes a traffic monitoring and reporting subsystem (TMS) 20 which is connected to the TTP 12 via the network 36.

The blocks denoted "processors," or "subsystems" can represent computer software instructions or groups of instructions. Portions of the RTCs 14, can also be implemented using computer software instructions. Such processing may be performed by a single processing apparatus which may, for example, be provided as part of the automatic roadway toll collection and management system 100.

In operation, the RTCs 14 control the collection of transaction data when a vehicle is detected. The detection includes transaction data and in certain situations described below, license plate images which are transmitted over the network 36 for processing by the plurality of transaction processors 24 included in the TTP 12. In one embodiment the images are stored on the image server 30. The transactions are processed in order to provide detections to the toll processor 28 to enable billing the customer for travel on the toll roadway. Such processing includes determining when a vehicle completes a trip (described below in further detail in conjunction with FIGS. 5–6).

A vehicle is detected, for example, when the vehicle enters a detection zone of one of the TPRs 16, enforcement gateways 17 or TGs 18 on the roadway. After detection or simultaneous with the detection of the vehicle, a transponder reading is collected if possible. If the vehicle does not have a transponder, the transponder fails, or verification of the use of the transponder is required, a video image is collected. The image is initially processed by the RTC 14 and then transmitted to the image server 30. The image is processed automatically by one of the VIP processors 22 using OCR techniques or correlation matching techniques using at least one verified image of the vehicles license plate. If the image cannot be processed automatically or the reading is required to be verified, then the image must be viewed manually by a human operator using the VEP 26 to determine the plate number. The real-time enforcement processor 32 processes information relating to law enforcement issues and distributes such information to law enforcement personnel.

The trip determination processor 40 processes vehicle detections and other roadway usage information and determines the most likely set of detections forming a trip. The roadway usage information considered is: roadway topology, time of each gateway detection, incidents along the roadway near the gateway detection times, billing policies, and tolling system delays. Using this information, the trip determination processor 40 determines the boundaries of each actual trip.

The trip determination processor 40 determines when it would be premature to declare the trip complete. Thus, once the trip determination processor 40 decides to declare the trip complete, it does not reprocess the detections included in that decision, thus simplifying the billing and accounting processes.

The TMS 20 includes an incident detection system which provides information used to account for expected transactions which are overdue. This information can assist the trip determination processor 40 in the determination of trips completed by vehicles traveling in the toll roadway. The incident detection system can be of a type described in U.S. patent application Ser. No. 09/805,849, entitled Predictive Automatic Incident Detection Using Automatic Vehicle Identification filed Mar. 14, 2001, said patent application assigned to the assignee of the present invention, and incorporated herein by reference.

Figure 2:
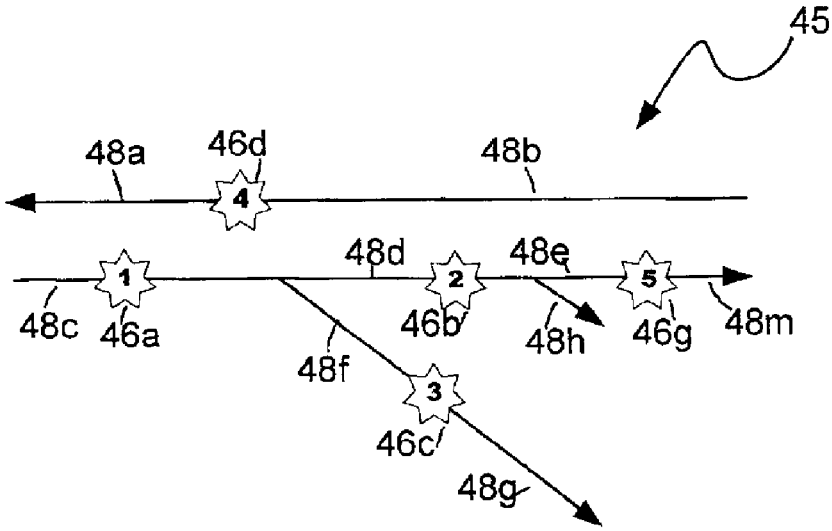
FIG. 2 is a schematic diagram of a segment of an exemplary roadway topology.

Now referring to FIG. 2, a roadway schematic 45 shows a simplified exemplary roadway topology including a plurality of gateways 46*a*–46*g*, for example, here TGs 18 (FIG. 1). "G" is the number of gateways in the toll roadway independent of roadway topology. It will be appreciated by those of ordinary skill in the art that enforcement gateways 17 and TPRs 16 and other sensors are used as detection devices in addition to the TGs 18. The gateways 46*a*–46*g* are interconnected by a plurality of roadway segments 48*a*–48*m*. The trip determination processor 40 can operate in a roadway having an arbitrary topology including but not limited to toll roads where vehicles can make loop trips or have multiple routes to a destination. The topology of the exemplary roadway is described by the matrices as shown in Table I in which:

G=number of gateways in the toll road network. Gateways are numbered 1, . . . , G, independent of road network topology.

TABLE I $$S = \begin{matrix} 0 & 1 & 1 & 0 & 2 \\ 0 & 0 & 0 & 0 & 1 \\ 0 & 0 & 0 & 0 & 0 \\ 0 & 0 & 0 & 0 & 0 \\ 0 & 0 & 0 & 0 & 0 \end{matrix}$$

$$T_{max} = \begin{matrix} 0 & 10 & 11 & 0 & 15 \\ 0 & 0 & 0 & 0 & 8 \\ 0 & 0 & 0 & 0 & 0 \\ 0 & 0 & 0 & 0 & 0 \\ 0 & 0 & 0 & 0 & 0 \end{matrix}$$

$$T_{min} = \begin{matrix} 0 & 1 & 1 & 0 & 2 \\ 0 & 0 & 0 & 0 & 2 \\ 0 & 0 & 0 & 0 & 0 \\ 0 & 6 & 6 & 0 & 0 \\ 0 & 0 & 0 & 0 & 0 \end{matrix}$$

Note that the above exemplary road network includes a "Y" configuration (formed by roadway segments 48*d* and 48*f*). It will be appreciated by those of ordinary skill in the art that other roadway configurations are possible including more complex topologies.

Segment Connectivity is represent by matrix $\underline{S}(i, j)$ the minimum number of road segments connecting any two gateways 46*i* and *j* in the road network when traveling from i to j. $\underline{S}(i, j)$ is 0 if there is no connectivity within the road network from gateway i to gateway j. This matrix is used to identify which transactions can be chained together into a single trip as a function of the roadway. For example, G=5 for the topology of Table I, and S(1,5)=2 indicates that traveling from $TG_1$ 46*a* to $TG_5$ 46*g* the minimum number of road segments connecting these gateways is two, including roadway segments 48*d* and 48*e*.

A maximum travel time is represented by $T_{max}$ (i, j) the incident free maximum travel time from gateway i to gateway j when no incidents exist along the route from i to j. $T_{max}$ (i, j) is zero if there is no connectivity within the road network from gateway i to gateway j. When a traffic incident causing a severe blockage of traffic is detected, the traffic incident data is used to extend the maximum time allowed until the incident is cleared. Presumably, most vehicles will eventually get from point i to j. $T_{max,}$ (i, j) is set to zero only for cases where it is physically impossible to travel from i to j based on the road geometry. In the exemplary roadway of Table I, the maximum travel time from gateway $TG_1$ to gateway $TG_5$, $T_{max}$ (1,G), is 15 arbitrary time units.

An expected maximum travel time is represented by $T_{exp}$ (t, i, j) (not shown) that is the expected maximum travel time from gateway TGi to gateway TGj at time t including the effect of incidents along the route from TGi to TGj. $T_{exp}$ (t, i, j) is 0 if there is no connectivity within the road network from gateway TGi to gateway TGj. $T_{exp}$ (t, i, j)>=$T_{max}$ (i, j). After a traffic incident is detected, the expected travel times are modified in response to traffic incidents. This matrix is used to separate successive trips. The minimum travel time is represented by $T_{min}$ (i, j) the minimum travel time from gateway i to gateway j regardless of whether there is connectivity between gateways TGi and TGj within the road network. This matrix is used to optionally filter erroneous vehicle detections. No filtering is performed when $T_{min}$ is all zeros.

Figure 3:
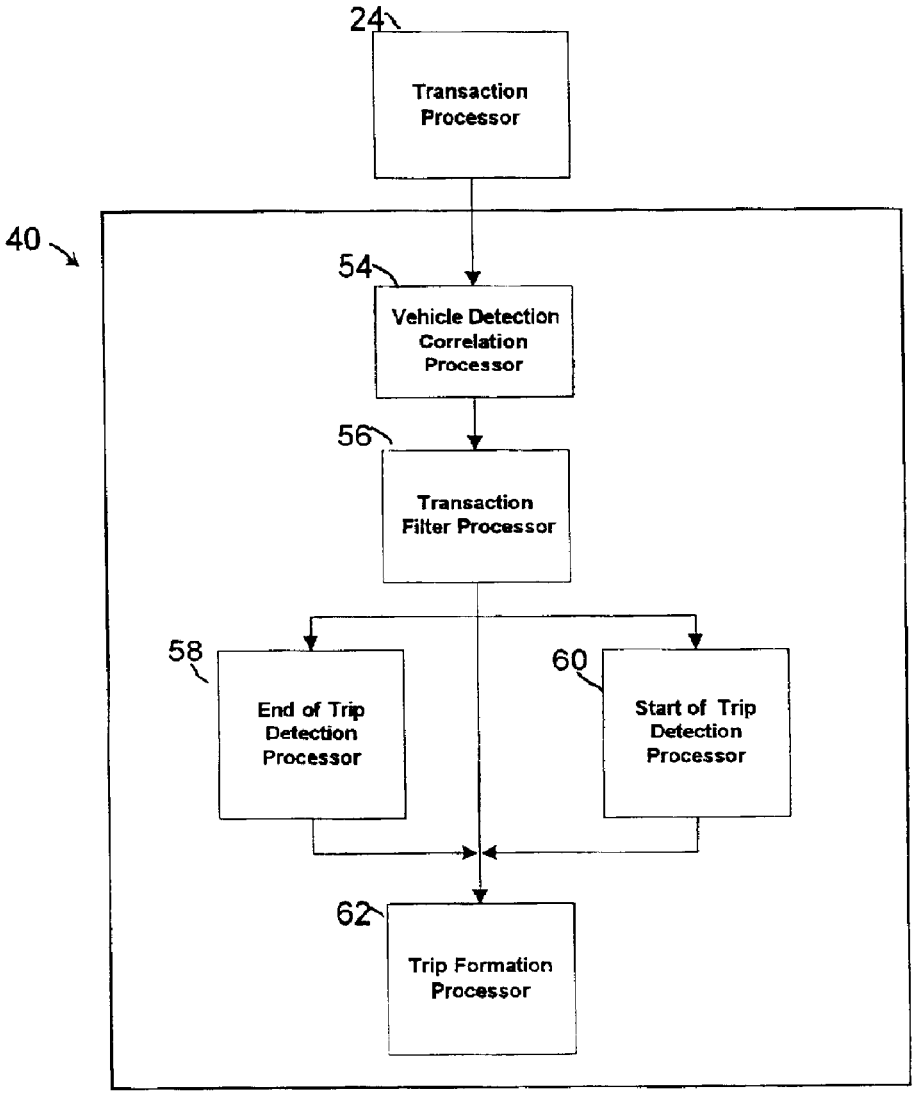
FIG. 3 is a block diagram of a trip determination subsystem according to the invention.

Now referring to FIG. 3, the trip determination processor 40 includes a vehicle detection correlation processor 54. The vehicle detection correlation processor 54 is coupled to a transaction filter processor 56. The transaction filter processor 56 is coupled to an end of a trip detection processor 58, and a start of a trip detection processor 60. The transaction filter processor 56, the end of a trip detection processor 58, and the start of a trip detection processor 60 are coupled to a trip formation processor 62. A transaction processor 24 (FIG. 1) is coupled to the vehicle detection correlation processor 54.

The blocks denoted "processors" can represent computer software instructions or groups of instructions performed by a processing apparatus or a digital computer. Such processing may be performed by a single processing apparatus that may, for example, be provided as part of the trip determination processor 40 such as that to be described below in conjunction with method described in FIGS. 4–5. Alternatively, the processing blocks represent steps performed by functionally equivalent circuits such as a digital signal processor circuit or an application specific integrated circuit (ASIC).

The following Trip Notation is used to explain the operation of the processors 54–62. Trips are formed from chained detections on a single vehicle.

$D_n$ represents the $n_{th}$ detection of a plurality of detections which are currently being processed for the vehicle;

$D_n \rightarrow D_{n+1}$ indicates that $D_{n+1}$ chains to preceding detection $D_n$;

$\|D_n$ indicates that $D_n$ is the first detection in the trip;

$D_n\|$ indicates that $D_n$ is the last detection in the trip;

$$\{D_1, D_2, D_3\} \Rightarrow \|D_1 \rightarrow D_2 \rightarrow D_3\| \begin{cases} \text{shows that the given set of 3} \\ \text{detections chain together into} \\ \text{a single trip; and} \end{cases}$$

$$\{D_1, D_2, D_3\} \Rightarrow \|D_1\| \, \|D_2\| \, \|D_3\| \begin{cases} \text{shows that the given set of 3} \\ \text{detections form 3 single} \\ \text{gateway trips.} \end{cases}$$

In operation, the transaction processor 24 receives a plurality of transactions provided by vehicle detections from one of the plurality of RTCs 14 which is coupled to at least one of the plurality of TPRs 16, enforcement gateways 17 and TGs 18. After the transaction is initially processed and converted into a detection, it is sent to the vehicle detection correlation processor 54. Each of the detections includes a time of detection of the vehicle and location identifying information. The location identifying information is provided as a unique ID or location data sufficient to provide an indication of the physical position of the detecting equipment.

It will be appreciated by those of ordinary skill in the art, that several parameters are used to tune the trip detection operation of processors 54–62. One such parameter is a Tolling Policy Parameter, $s_{max}$, which defines the maximum number of missed detections allowable between successive detections of a vehicle on a given trip.

The trip determination processor 40 forms trips at time T for vehicle k by processing a set of candidate detections provided by the transaction processors 24. If a particular vehicle k is detected during the interval $\{t_m, t_n\}$, the set of detections on that vehicle are:

$\delta_k(t_m,t_n)=\{D_l, i=1, \ldots, N_k\}$, where $N_k$=number of detections of vehicle k during $\{t_m,t_n\}$;

$D_l=(g_l,t_l)$ is the ith detection in the interval, reported from gateway $g_l$ at time $t_l$;

k is the vehicle number with having a unique identification;

$t_m$ is the time of the first detection on vehicle k not already declared as part of a trip or already declared ineligible for trip formation, as of time T; and $t_n$ is the latest time for which all detections are known to have been received.

Further, without loss of generality, the detections are time ordered, i.e.:

$$t_m \leqq t_1 \leqq t_2 \leqq \ldots \leqq t_{N_k} \leqq t_n.$$

It should be noted that the constraint imposed by $t_n$ prevents trips from being formed prematurely due to transactions arriving out of time order.)

The vehicle detection correlation processor 54 correlates vehicle detections using the following criteria:

For $1 \leqq i \leqq N_k$ and j>i, the correlation index $\rho(D_l,D_j)$ is defined as:

$$\rho(D_i, D_j) = \begin{cases} 1 \text{ if } 0 < S(g_i, g_j) \leq (s_{\max} + 1) \text{ and} \\ T_{\min}(g_i, g_j) < t_j - t_i < T_{\exp}(t_j, g_i, g_j) \\ 0 \text{ otherwise} \end{cases} \quad (1)$$

The definition indicates that $D_l$ and $D_j$ are positively correlated if the detections come from gateways that are logically consistent with the roadway topology, and the travel time between them is reasonable, i.e. within a predetermined limit of the expected travel time under prevailing traffic conditions.

A detection chains to Di if the correlation index =1 as represented in:

$D_l \rightarrow D_j$ if $\rho(D_l,D_j)=1$, for the smallest $j$ where $j>i$ and any detections between $D_i$ and $D_j$ are filtered according to equation (3) below. (2)

For example, using the roadway topology of FIG. 2, an exemplary set of detections includes the following detections (gateway, time in arbitrary units) which have been collected for vehicle V:

$$\{D_1=(1,100), D_2=(2,105), D_3=(3,110)\}$$

Then, according to equation (1), each correlation index is determined as follows:

$$\rho((1,100),(2,105))=1$$

$$\rho((1,100),(3,110))=1$$

$$\rho((2,105),(3,110))=0$$

Note that $D_2$ and $D_3$ do not correlate because S(2, 3)=0, i.e. there is no connectivity within the road network from gateway 2 to gateway 3.

$$\|D_1 \rightarrow D_2\| \begin{cases} \text{shows that the given set of 2 detections chain} \\ \text{together into a single trip} \end{cases}$$

Note that even though (1,100) correlates to (3,110), the detections are not chained because (1,100) will be chained to the first possible detection which is (2,105). This is the case even if (2,105) is received after (3,110).

The transaction filter processor 56 filters erroneous transactions, which do not meet various time and topology criteria as provided in:

$D_i$ is filtered if: $T_{min}(g_{i-1},g_l)>0$ and $t_i-t_{i-1}<T_{min}(g_{i-1},g_i)$ for $i>1$ (3)

The trip determination processor 40 forms trips by identifying start points, end points, and correlated detections.

The start of a trip Detection Processor 60 determines a start to a trip using the following criteria:

Start of Trip $$\|D_i \text{ if } \begin{cases} i = 1 \\ i > 1 \text{ and } \rho(D_{i-1}, D_i) = 0 \end{cases} \quad (4)$$

The technique doesn't allow trips to be formed prematurely, thus the first unchained detection must be the start of a new trip rather than a continuation of a trip already formed. In addition, if two given detections do not correlate, it reflects a break between two trips where the second detection is the start of the second trip.

In the example above, the following start of trip is detected:

||(1, 105) indicates the first detection in the trip is the start of the trip.

The end of a trip Detection Processor 58 determines an end to a trip using the following criteria:

End of Trip $$D_i\|\text{if} \begin{cases} i < N_k & \text{and } \rho(D_i, D_{i+1}) = 0 \text{ and } t_n > t_i + \\ & T_{\exp}(t_i + T_{\max}(g_i, g_j), g_i, g_j) \\ & \text{for each } j \text{ in which } 0 < S(g_i, g_j) \le s_{\max} + 1 \\ i = N_k & \text{and } t_n > t_i + T_{\exp}(t_i + T_{\max}(g_i, g_j), g_i, g_j) \\ & \text{for each } j \text{ in which } 0 < S(g_i, g_j) \le s_{\max} + 1 \end{cases} \quad (5)$$

Figure 6A:
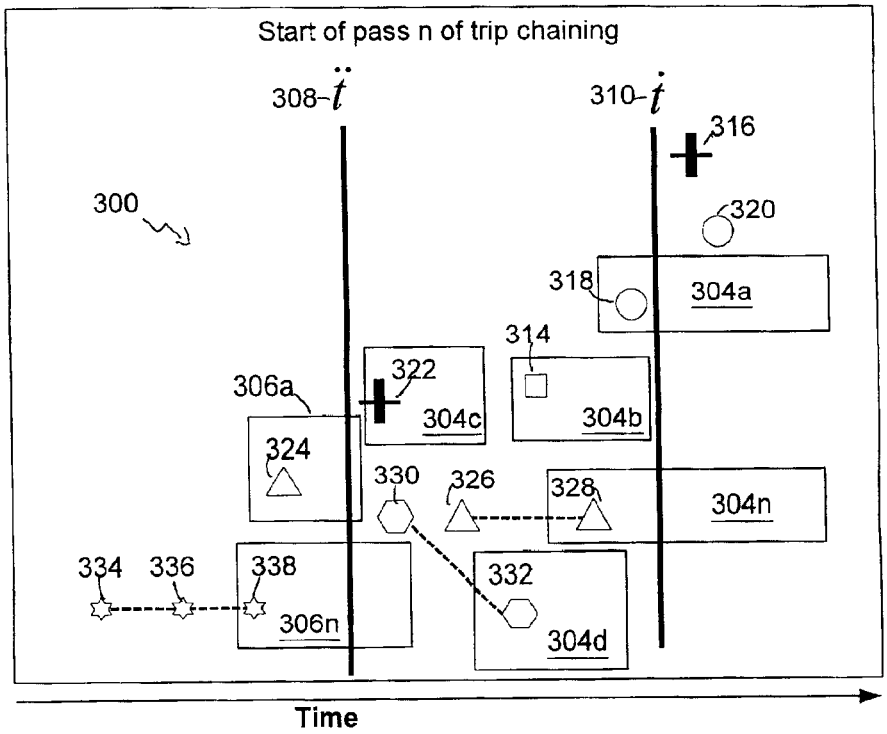
FIG. 6A is a timing diagram showing transactions being processed during one iteration of the trip determination and chaining method of FIGS. 4 and 5.
Figure 6B:
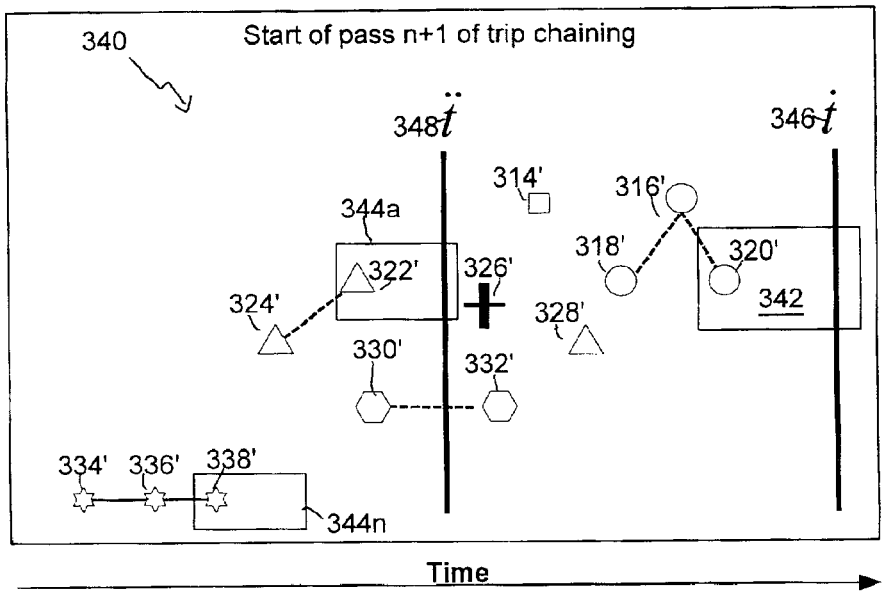
FIG. 6B is a timing diagram showing transactions being processed during an iteration subsequent to the iteration of FIG. 6A.

The first condition excludes detection, $D_i$ from being the end of the trip if it correlates to $D_{i+1}$. The second condition in equation (5) requires that sufficient time has elapsed to determine that there cannot be an outstanding detection that would correlate to the detection being processed. To determine this, all possible subsequent gateways, as defined by S and $s_{max}$ must be considered. For each possible subsequent gateway beyond $D_i$, the maximum detection time that could possibly chain is computed. The maximum detection time within which detections that could possibly chain is illustrated in FIGS. 6A and 6B and referred to as an extrapolation region. It is determined whether the latest detection time (also referred to as the current boundary time), $t_n$, is greater than the maximum detection time that could possibly chain. If the current boundary time, $t_n$, is greater than the maximum detection time that could possibly chain, the end of trip is declared because there are no detections with a time of less then $t_n$ that will be received later and thus no future detections can possibly chain to $D_i$. The latest time for which all detections are known to have been received, $t_n$, is calculated in a reliable manner taking into consideration all places in the tolling system where a transaction could be buffered, including but not limited to, the memory of the various processors, hard disks, and the network.

In other words, before the end of the trip can be declared, the trip determination processor 40 must wait for all the detections that could possibly chain on to the last detection. At some point in the detection time space, $t_n$, it is no longer possible to have a detection which will chain to the last known detection which is then declared the end of the trip. The latest time, $t_n$, is referred to as time marker $\dot{t}$ for potential trips (described below in conjunction with step 120, FIG. 4) and to time marker $\ddot{t}$ for firm trips (described below in conjunction with step 142 FIG. 4). The latest time, $t_n$, is referred to below as the "trip boundary time" in conjunction with step 254 (FIG. 5).

In the example above assuming there are no incidents, the following end of trip (2,105) || is not detected until $t_n$=113 because $T_{max}$(2, 5)=8 and 105+8=113.

A key feature of this invention is the determination of when it would be premature to declare a trip complete. Thus, once a decision is made to declare that a vehicle has completed a billable trip, there is a relatively small probability of an error in that decision. This final determination process simplifies the billing and accounting processes.

The Trip Formation Processor 62 forms trips by chaining detections between the boundaries located by the end of a trip Detection Processor 58 and the start of a trip detection processor 60. Trip Formation Processor 62 chains detections according to the criteria of equation (2). For example, detection $D_l$ chains with $D_j$ if $D_l$ and $D_j$ are correlated. In the example above, the following trips are formed:

||(1,105)→(2,105)|| ||(3,110)||, here ||(3,110)|| is a single gateway trip.

Figure 4:
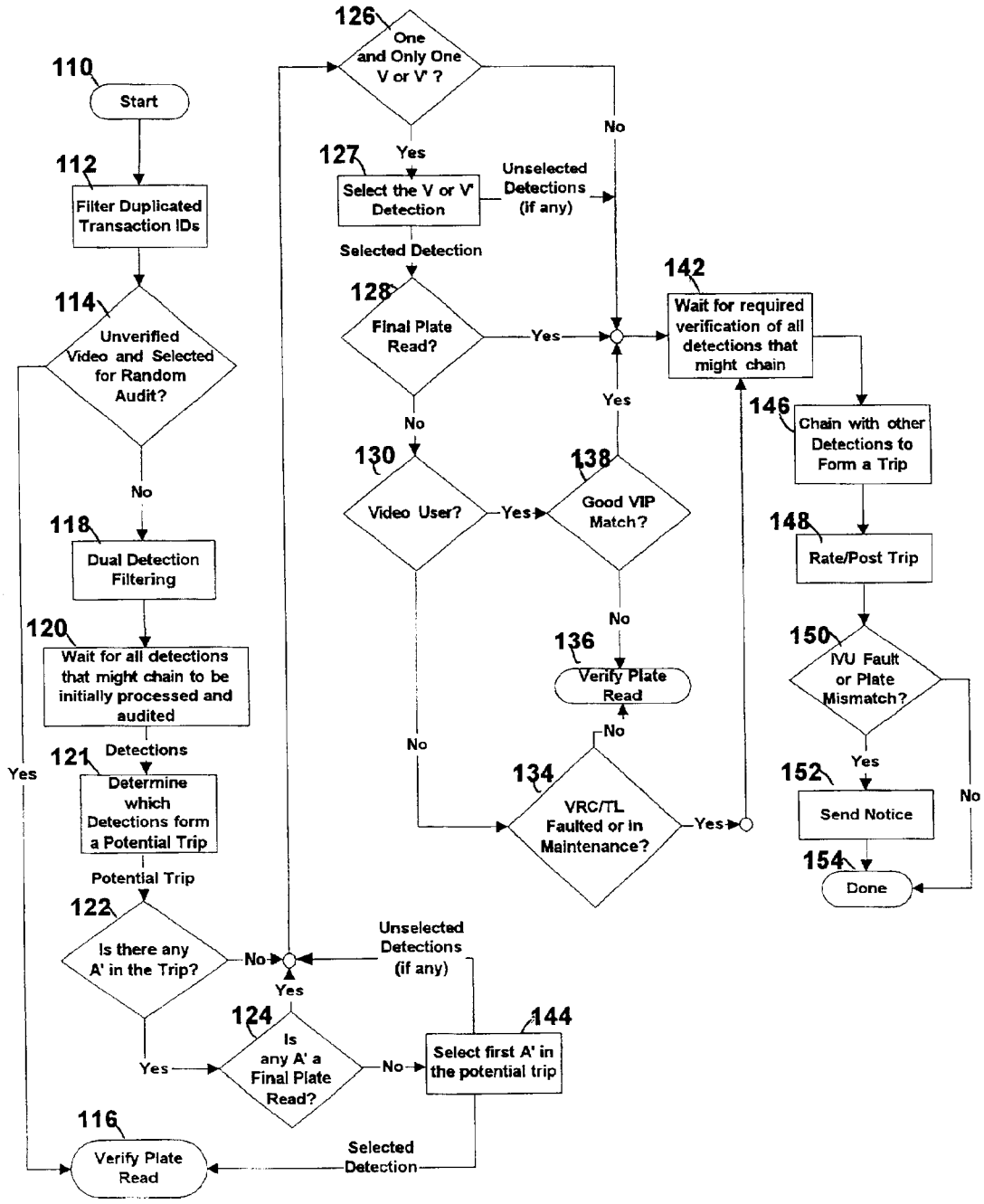
FIG. 4 is a flow diagram illustrating the steps of determining a trip according to the invention.
Figure 5:
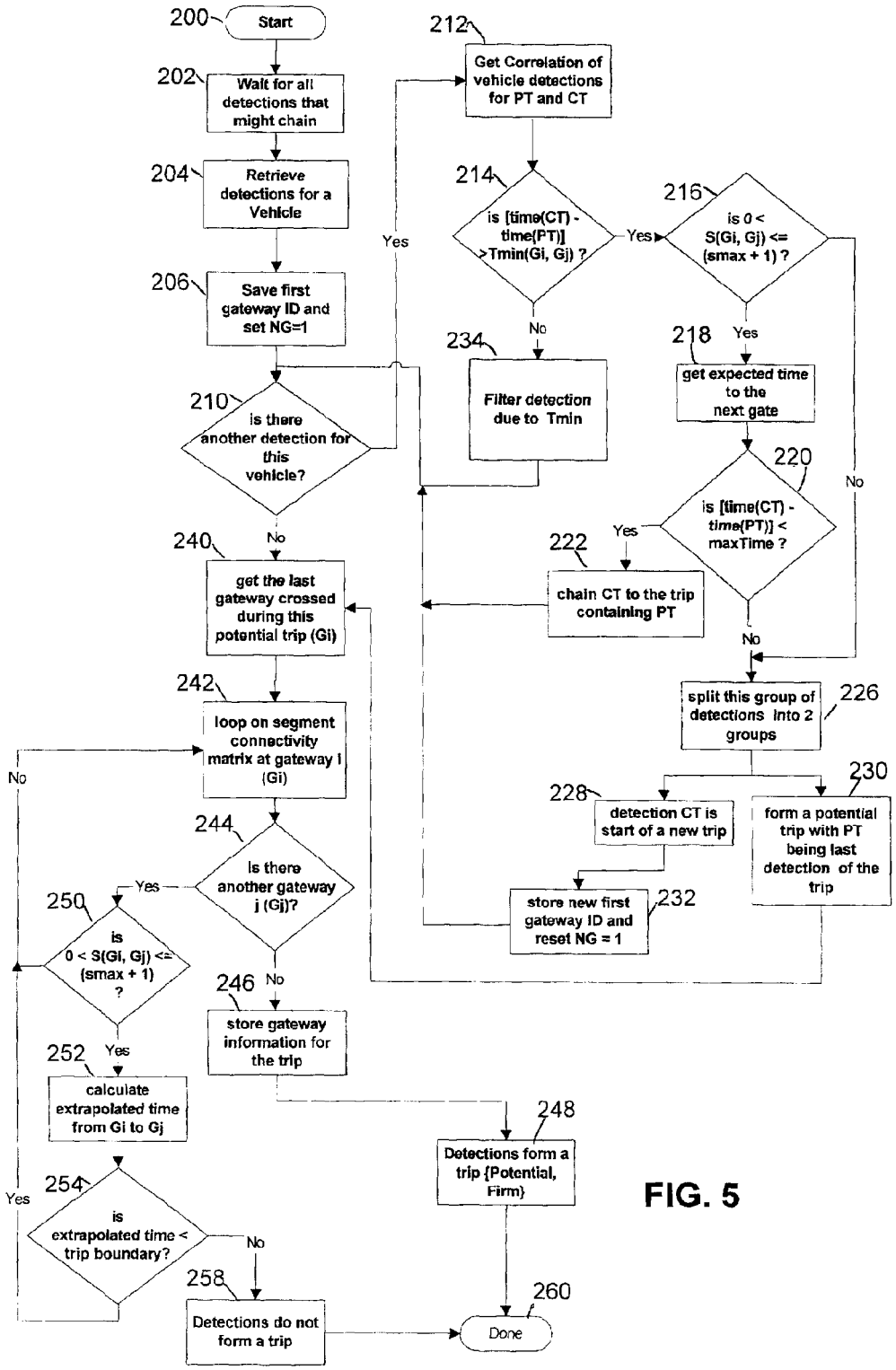
FIG. 5 is a flow diagram illustrating the steps of correlating and chaining detections to form a trip according to the invention.

In the flow diagrams of FIGS. 4–5, the rectangular elements are herein denoted "processing blocks" (typified by element 202 in FIG. 5) and represent computer software instructions or groups of instructions. The diamond shaped elements in the flow diagrams are herein denoted "decision blocks" (typified by element 214 in FIG. 5) and represent computer software instructions or groups of instructions which affect the operation of the processing blocks. Alternatively, the processing blocks represent steps performed by functionally equivalent circuits such as a digital signal processor circuit or an application specific integrated circuit (ASIC). It will be appreciated by those of ordinary skill in the art that some of the steps described in the flow diagrams may be implemented via computer software while others may be implemented in a different manner (e.g. via an empirical procedure). The flow diagrams do not depict the syntax of any particular programming language. Rather, the flow diagrams illustrate the functional information used to generate computer software to perform the required processing. It should be noted that many routine program elements, such as initialization of loops and variables and the use of temporary variables, are not shown. It will be appreciated by those of ordinary skill in the art that unless otherwise indicated herein, the particular sequence of steps described is illustrative only and can be varied without departing from the spirit of the invention.

Referring now to FIG. 4, at step 110 processing commences to determine if any additional detections which form a trip taken by an individual vehicle add information which is useful in determining and verifying the plate number of the vehicle. For example, if the same plate number is read at two consecutive TGs 18 and the transit time between the two TGs 18 was reasonable for current traffic conditions, there is a relatively high confidence that the plate number is correct. License plate images are generally included in the detections when the RTC 14 determines the images are required. The inclusion of the images in a detection can result in manual read operations. The consecutive reads described above, for example, provide a reduction in the number of manual reads because, here, no manual read would be required for verification purposes for the two detections even if the detections included video images.

In one embodiment, in which the system 100 includes a high percentage of vehicles equipped with transponders, the majority of the transactions and resulting detections will include only AVI readings and under normal circumstances no verification of these AVI readings will be required. A detection is result of processing one or more transactions and represents the actual event of a vehicle being detected by the roadside equipment. Although most detections no not require verification, there are several situation where video images are required and made available to the trip determination sub-system 40. In systems with a relatively lower percentage of AVI readings and systems which rely to a greater extent on video capture a relatively larger number of verifications is required. Table I illustrates four different types of detection categories used for trip processing. A vehicle ID is a unique number assigned to each vehicle identified by the system. The vehicle ID is associated with a license plate number (also referred to as plate characters).

TABLE I

| | Detection Types | |
|---|---|---|
| | Components | Source of Vehicle ID |
| A | AVI Only | IVU ID |
| A' | AVI + Video | IVU ID |
| V | Video Only | Plate Characters |
| V' | Video + AVI | Plate Characters |

For example, an "A" type detection includes only a transponder reading. The "A" type detection is the normal detection in the case of a transponder user where there are no hardware problems, no class mismatch, and no reported problems with the customer account associated with the AVI reading. An A' detection is, for example, a detection that might indicate that a customer has switched a transponder from one vehicle to another without authorization, and the system 100 has determined that video images are required to determine which vehicle actually is using the transponder. In both the A and A', detections, the IVU ID is used to determine the Vehicle ID.

The V' detection is, for example, a detection also including a video image with a transponder reading, but might be used when a transponder has been reported stolen. In this situation, the transponder is likely to be on a different vehicle than the one identified by the Vehicle ID registered to the transponder so the system 100 will try to read the plate image to determine the license plate number. It is important to verify at least one of the A' and V' detections if there are any in a trip, and in many situations this will involve manual reads using the VEP 26.

The Vehicle ID is normally derived from the IVU ID when a detection has both AVI and Video components. The specific conditions under which the Vehicle ID is derived depend on the roadway operator's policy.

Additional manual reads can result from verifications requested by the trip processor described below in steps 380 to 424. Verifications place a load on the manual read sub-system which also must process images for which there is no other means of identification. A reduction in the number of verifications reduces the overall number of required manual reads. An example of a required verification occurs when the system discovers a vehicle class mismatch. This might occur when a transponder is moved from a car to a truck. The system will detect this situation and capture a video image of the license plate to determine which vehicle is using the transponder. Another situation where verification is required with transponder usage occurs when a transponder is stolen. In this situation, it is important to verify the license plate because law enforcement is likely to be involved.

At step 112, duplicated transactions 44 and conflicting gateway crossings are filtered out by using a unique internal system ID assigned to each transaction 44. Duplicate transactions 44 can occur, for example, when the network erroneously retransmits the transaction 44. Conflicting gateway crossing can be caused by a vehicle leaving the roadway having transactions 44 indicating a break between two trips or a crossing not physically possible to reach in the amount of elapsed time. In case of such ambiguous transactions 44, the transaction is filtered, optionally billed separately, and the transaction is logged since it may indicate a toll evader. In one embodiment, ambiguities are eliminated by filtering and giving priority to the first transaction in an ambiguous set. Processing continues at step 114.

At step 114, it is determined if video image of the license plate is unverified and selected for a random audit. If the video image is unverified and selected for a random audit, processing continues at step 116, otherwise processing continues at step 118.

At step 116, the plate read is verified. Verification is performed manually by tasking an operator who has not yet viewed the sub-image to read the plate number. If the operator reads the same plate number, verification is successful. Otherwise, additional processing is performed by the VEP 26 to attempt to determine the true plate number by manually reading the plate image. At step 116, if verification doesn't result in a change to the plate characters or an "unreadable" plate processing will resume at step 142. If the plate characters change, the detection will be reprocessed and possibly chained into a different trip at steps 142 and 144.

At step 118, dual detection filtering filters out the extraneous video detections, i.e. detections with available license plate images, and processing continues at step 120. It is possible due to equipment degradation to get separate video and AVI detections for the same toll gateway crossing. In one embodiment, in step 118, the detections are tagged as to the type A, A', V or V'.

At step 120, the system waits for all detections that might chain to be initially processed and audited. Audits and verifications are processed identically, but occur for different reasons. In one embodiment, the operator can adjust the percentage of images sent back for audit, which are selected at random. In order to reduce manual reads, the trip determination processor 40 can determine if license plate reads which might fit into a trip do not have to be verified manually. To reduce manual reads, the trip processor must wait for all possible detections which might be part of a trip. Because some detections might be delayed before they become available for processing or because some detections might be delayed in the auditing process, the system must wait for some detections to be processed and audited. The trip determination processor 40 can either wait a long time relative to transaction processing or use a sliding time window process which identifies the time frame of available transactions for trip determination. The process for manually reading license plate images is described in further detail in U.S. patent application Ser. No. 10/058,511, entitled System And Method For Reading License Plates filed Jan. 28, 2002, said patent application assigned to the assignee of the present invention, and incorporated herein by reference. All the detections that might chain can be processed as a group with the possibility that the number of verifications is reduced. A potential trip can have any combination of A, A', V or V' detections in any number or sequence limited only by the road geometry. In practice, a single potential trip containing both A' and V' detections is rare, but the possibility does exist.

At step 121 the plurality of detections which might form a potential trip, are chained together and processing continues at step 122.

At step 122, it is determined if there are any A' detections in the potential trip, for example if the measured class of the vehicle corresponding to the original detection is a mismatch. If there is an A' detection then processing continues at step 124, otherwise processing continues at step 126. It should be noted that all remaining detections in the potential trips are included in the detections which are processed in steps 124 and 126.

At step 124, it is determined if any A' detection is a detection having video with a final plate read. If there is a final plate read, then processing continues at step 126, otherwise processing continues at step 144. It should be noted that all remaining detections in the potential trips are included in the detections which are processed in step 144 and 126.

At step 144, the first A' detection in the potential trip is selected for verification at step 116. Remaining unselected detections (if any) which bypass verification are processed at step 126. At step 144, instead of verifying all of the video images in the A' detections, a single detection, here being the first A' detection, is verified resulting in fewer manual read operations.

At step 126, it is determined if there is one and only one detection in the potential trip which is either a V or a V' detection, including for example a single gateway video trip, or a multi-gateway trip with either one video V detection or one V' detection including AVI data. Steps 126, 127, 128, 130, 134, 136, and 138 determine whether there is a relatively high probability of an error in the vehicle ID associated with one of the detections in the potential trip due to a misread of the plate characters in an image. By forcing a manual read or reread of such images, the system is able to focus VEP operator resources on the images with the highest probability of error to achieve a significant reduction in billing errors without excessively increasing VEP operator workload. A single gateway video trip occurs where a vehicle crosses a single gateway, a video image of the license plate is captured and the vehicle leaves the toll road. Such trips have a higher probability of error than trips with only A and A' detections or multi-gateway video trips because of the possibility of a single misread directly resulting in a billing error. However, it is not desirable to verify all single gateway video trips if there are a large number of such trips being traveled or RTC equipment failure at a specific location causes a large number of video only (V) detections to be created for what would otherwise be A detections. While a single gateway video trip is the simplest example of a trip that will be routed to step 127 for further consideration of the need to perform verification, step 126 also allows for the more general case of any trip with exactly one V or V' detection, but not both together in the same trip since that would be a multi-gateway video trip. If there is one and only one V or V' detection, processing continues at step 127, otherwise processing continues at step 142.

At step 127, the V or V' detection (of which there is only one) is selected from the plurality of detections and processed at step 128, the remaining (unselected detections) are processed at step 142.

At step 128, it is determined if this is the final plate read for this image, i.e. is the one video detection from step 127 marked as "Final Plate Read" or "Non-final" Plate Read. If this is the final plate read for the video detection then processing continues at step 142, otherwise processing continues at step 130.

At step 130, it is determined if the customer associated with the selected detection is a video user, i.e. there is no registered transponder for the read plate. An unregistered user is considered a "video user" by default in one embodiment. If this customer is a Video User then processing continues at step 138, otherwise processing continues at step 134.

At step 134, it is determined if a fault or maintenance activity has occurred at the location where the detection was captured. If either of these activities has occurred and is associated with the current detection then processing continues at step 142, otherwise processing continues at step 136. In step 134, A or A' detections which were captured as V detections due to equipment failure or maintenance, (e.g., an AVI RF antenna was turned off), are not verified in order to reduce the manual read workload.

At step 136, the plate read is verified and if verification doesn't result in a change to the plate characters or an "unreadable" plate processing will resume at step 142 when all required verifications for detections which include license plate images for the vehicle which might chain have been completed. If the plate characters change, the detection will be reprocessed and possibly chained into a different trip at steps 142 and 144.

At step 138, it is determined if the VIP Match is good, i.e. a prior correlation with a verified image resulted in a match over threshold. If the VIP Match is good then processing continues at step 142, otherwise processing continues at step 136.

At step 142, the system 100 waits for required verification of all detections that might chain (similar to step 120). After the detections that might chain are available for processing and have been verified as required, processing continues at step 146. One embodiment waits for detections by using a batch processing technique as described below in further detail in conjunction with FIGS. 6A and 6B. After a batch of detections is processed, processing continues at step 146. In one embodiment, the toll processor 28 can include a delay before processing the transactions 44. In an alternate embodiment, the toll processor 28 can include a sliding time window, which is a different window than the window in step 120.

At step 146, the detections are chained together to form a firm trip and processing continues at step 148. At step 146, trips in addition to trips having selected/non-selected detections are formed. Step 146 is described below in further detail in conjunction with FIG. 5.

At step 148, the plate reading and trip chaining process is complete and the trip if one is determined can be rated and posted and the customer can be billed. After a firm trip is determined, there are no more plate reads for the chained detections. All verification and evaluation of potential trips occurs before the trip is formed. Thus, trip determination simplifies the interface to the billing system and reduces the number of manual reads. Trip processing does affect plate reading by sending detections back for manual verification, but this occurs as the result of evaluating potential trips, not firm trips. Processing continues at step 150.

At step 150, it is determined if there is IVU Fault or Plate Mismatch. If there is IVU Fault or Plate Mismatch then a notice and/or a class mismatch fine is sent to the customer in step 152 and processing terminates at step 154. At step 154, processing terminates.

Referring now to FIG. 5, a flow diagram illustrates the steps in one embodiment for processing a plurality of vehicle transactions including detecting a trip start point, correlating a plurality of vehicle detections, and determining the boundaries of the trip in response to a plurality of roadway usage factors and the correlated detections.

In conjunction with FIG. 5 the following notation is used to describe some of the steps for chaining detections to form trips or potential trips:

PT=the previous detection;

CT=the current detection;

Gi=gateway of PT;

Gj=gateway of CT;

S(Gi, Gj): segment connectivity table;

Tmax(Gi, Gj): max travel time table;

Tmin(Gi, Gj): min travel time;

$s_{max}$: max # of skipped gateways allowed; and

S(Gi, Gj), Tmax(Gi, Gj), Tmin(Gi, Gj), and $s_{max}$ are configurable parameters adjusted by the roadway operator.

FIG. 5 is an illustration of the detailed process flow of forming a trip as described above in conjunction with step 121 (FIG. 4) and with step 146 (FIG. 4). In step 121 potential trips are formed, and in step 146 firm trips are formed. In one particular embodiment, the process of forming a trip uses the techniques embodied in equations (1–5) above.

At step 200, a vehicle for which there is at least one transaction is selected and the trip determination process is started. The process described in FIG. 4 operates on transactions which have been verified and can be associated with a specific vehicle with a relatively high probability.

At step 202, a determination is made as to whether all detections for the selected vehicle, which might chain together have been collected. If there might be more detections available processing of another vehicle resumes at step 200. After collecting detections, which potentially form a trip, processing continues at step 204. One embodiment waits for detections by using a batch processing technique and is described below in further detail in conjunction with FIGS. 6A and 6B.

A trip is formed in steps 204–260 by identifying start points, end points, and correlated detections as described in the following steps. At step 204, a trip transaction for the selected vehicle is retrieved, for example, from a transaction processor or a transaction database. The transactions are processed to generate a set of detections for a vehicle. As described above a transaction provides a time and location with a vehicle identification. A roadside device using an AVI reader, a license plate reading system, a card reader or any system which can provide an identification of a vehicle can generate a transaction sufficient to provide detection information.

At step 206, the number of gateways traversed per trip (NG) is initialized to 1 and the ID of each gateway in the current detection is stored for later use. At step 210 it is determined if the current transaction is the last transaction for the selected vehicle. If it is determined that there are more transaction for the selected vehicle processing continues at step 212, otherwise processing continues at step 240.

Steps 212 to 232 are repeated for the remaining group of transactions for the selected vehicle. If there are no more transactions for the selected vehicle processing continues at step 240.

At step 212 the previous and current detections are checked for a positive correlation to determine if a pair of detections can be chained together. The previous detection is retrieved and correlated with the current detection in steps 214 and 216.

At step 214, it is determined, for example by using the constraint of equation (3), whether the travel time between two gateways is reasonable using the following comparison:

$$[\text{time}(CT)-\text{time}(PT)]>Tmin(Gi,Gj);$$

where Tmin(Gi, Gj) is the min travel time between gateways Gi, Gj . If the travel time is reasonable processing continues at step 216 to further test for positive correlation, otherwise processing continues at step 234.

In one embodiment, the trip processor uses equation (1), for example, in steps 216, 218 and 220 to correlate the detections. At step 216, it is determined whether the detected gateways are logically consistent with the road topology, using a gateway segment connectivity table S(Gi, Gj) and with the following test:

$$\text{is } 0<S(Gi,Gj)<=(s_{max}+1);$$

where $s_{max}$ is the maximum number of skipped gateways allowed. In one embodiment, $s_{max}$ is based on the business rules of the roadway operator including such things as any minimum trip charge and for the possibility that the RTC 14 occasionally fails to detect a vehicle due to equipment failure. If the detections are positively correlated (i.e. they come from gateways that are logically consistent with the road topology, and the travel time between them is reasonable) then processing continues at step 218, otherwise processing continues at step 226.

At step 218, the expected time $T_{exp}$ to the next gateway is retrieved, for example, from a travel time table database which includes the expected travel time between pairs of roadside devices which detect vehicles.

At step 220, it is determined whether the difference between the time of the current detection and the time of the previous detection is less than a maxTime, where maxTime is the maximum of Texp[time(CT), Gi, Gj] and Tmax(Gi, Gj). In other words, maxTime is the longest permissible travel time between the two given gateways without breaking the detections into separate trips. "time difference" is the actual travel time between the two detections. If the time difference is less than the maximum time allowed for the detections to be chained then processing continues at step 222, otherwise processing continues at step 226.

At step 222, the current detection is chained to the potential trip or firm trip containing the previous detection, the chaining determined, for example, by using the constraint of equation (2). Processing resumes at step 210.

At step 226, the previous and current detections (PT and CT) are split into two groups, which can either be processed serially or in parallel. Processing continues at steps 228 and 230.

At step 228 the current transaction (CT) is processed as if it is the start of a new trip according to the constraints of equation (4). Processing continues at step 232. At step 232, the current gateway ID is stored as a new first gateway ID and the number of gateways is reset (NG=1). Processing resumes at step 210.

At step 230, if a firm trip is being formed (step 146 FIG. 5), the firm trip is formed with PT being last transaction of the trip. If a potential trip is being formed (step 120 FIG. 5), the potential trip is formed with PT being last transaction of the trip. Processing resumes at step 210.

At step 234, the filtered transaction is handled according to roadway rules, for example the rules below:

Single Gateway Filtered AVI transactions: Bill or Discard (Default=discard)

Single Gateway Filtered Video transactions: Bill or Discard (Default=discard)

Multiple Gateway Filtered transactions (AVI/video mix): Bill or Discard (Default=bill)

The exemplary default settings are based on an assumption that single gateway anomalies are more likely a system problem and multi-gateway anomalies are more likely due to a toll evader. Processing resumes at step 210.

At step 240, the last gateway crossed during the current potential trip (Gi) is retrieved.

At step 242, the process initializes a loop on the segment connectivity matrix at gateway i (Gi) in order to compute the extrapolated times for this potential trip or firm trip. Using the example from above for the following detections:

$$\|(1,105)\rightarrow(2,105), \text{ here}$$

i=2, so the process loops through S for j=1, 3, 4, 5.

At step 244, it is determined if is there another gateway j (Gj) in S in order to end the processing loop. If there is another gateway processing continues at step 250, otherwise processing continues at step 246.

At step 246, gateway information for the trip is stored in memory or a database, including the number of gateways (NG) and all IDs of gateways traversed in the current trip. Processing continues at step 248, where the potential trip is formed and reported to the transaction processor. Processing for the current vehicle terminates at step 260.

At step 248, a trip is formed and declared complete and sent to the toll processor 28 (FIG. 1) for billing purposes if a firm trip is being formed (step 146 FIG. 5). If a potential trip is being formed (step 120 FIG. 5), the detections forming the potential trip are processed as a group.

At step 250, the segment connectivity table is queried to see if there is connectivity between Gi and Gj in the current potential trip. If $0<S(Gi, Gj)<=(s_{max}+1)$ then there is connectivity between Gi and Gj and processing continues at step 252, otherwise processing continues at 242.

In the example described above, for the j=1, 3, 4 cases in the example, S(i, j)=0 so processing continues at 242. For j=5, processing continues at 252.

At step 252 the Extrapolated time is equal to the maximum time for detection of the next chainable transaction. The gateway's travel time table information and timestamp of last gateway traversed is used in the computation. Processing continues at step 254.

At step 254, it is determined whether the extrapolated time<trip boundary time, $t_n$. The trip boundary time is time marker $\dot{t}$ (described in conjunction with FIGS. 6A and 6B for potential trips or $\ddot{t}$ for firm trips (described below in conjunction with FIGS. 6A and 6B). If the extrapolated time is less than the trip boundary then processing continues at step 258. Otherwise processing continues at step 242 to continue looping on the segment connectivity matrix. In the example described above, $T_{max}(2, 5)=8$. Assuming that $T_{exp}(2, 5, 105)$ is <=8, then if $t_n$ is >=113, processing continues at 242, otherwise processing continues at 258.

At step 258, it is reported to the transaction processor that the transactions do not form a trip and processing for the current vehicle terminates at step 260. The current vehicle may have more transactions not captured in this group of transactions, an alternatively it is possible to try to chain the filtered transactions, as well as to decide on whether or not to bill them.

AVI information is not used to chain trips if it is suspect. In particular, IVU IDs are not used for chaining in the case of: lost IVUs, stolen IVUs, link validation failure , invalid agency programmed into transponder, or when the transponder is associated with an habitual violator. A link validation failure occurs the roadside toll collection subsystem 10 suspects a transponder may have been tampered with. Chaining of such suspect transactions is based on read plates only, i.e. the AVI information is ignored in the case of a transaction with both AVI and video information.

Now referring to FIGS. 6A and 6B, one method of waiting for vehicle transactions with associated vehicle detections is illustrated. In order to correctly determine a vehicle trip, the trip processor must wait for all possible transactions which might be part of a trip as described in conjunction with step 202 of FIG. 5 and steps 120 and 142 of FIG. 4. Because some transactions might be delayed before they become available for processing or because some transactions might be delayed in the verification process, the system must wait for some transactions to be processed and audited. The system 100 can either wait a long time relative to transaction processing or use a sliding time window process which identifies the time frame of available transactions for trip determination.

Now referring to FIG. 6A, a timing diagram 300 represents a pass n, occurring at current time T, of the process as described in the flow diagram of FIG. 4. The timing diagram 300 includes a plurality detections 314–332 which have been collected at various times in the past. The timing diagram 300 includes timing marker $\dot{t}$ 310 and a plurality of adjacent extrapolation regions 304*a*–304*n* and timing marker $\ddot{t}$ 308 and a plurality of adjacent extrapolation regions 306*a*–306*n*. Extrapolation region 304*a* includes detection 318, extrapolation region 304*b* includes detection 314, extrapolation region 304*c* includes detection 322, extrapolation region 304*d* includes detection 332 and extrapolation region 304*n* includes detection 328. Extrapolation region 306*a* includes detection 324 and extrapolation region 306*a* includes detection 338. The detections 314–332 can be in one of a number of states, for example, detection 316 is being audited; detections 314 and 322 are in an unknown verify state; detections 334 and 336 have completed verification; detections 330 and 332 do not need verification because they are chainable detections and neither is an A' detection.

Timing marker $\dot{t}$ 310 is the detection time for the oldest detection in the system that has not been made available to trip processing. This includes detections delayed at the roadside, detections waiting for OCR, and detections waiting for initial or audit manual reads. Waiting occurs at step 120 (FIG. 4). Here for example, Timing marker $\dot{t}$ 310 is being restricted by detection 316, which is a detection in process of being audited by the VEP subsystem 26 because there is no final license plate read on the image associated with the detection 316. There might however, be a preliminary read of the license plate number on the image associated with the detection 316 by using the OCR.

It should be noted that both $\dot{t}$ and $\ddot{t}$ can never go backwards. It is required that $\ddot{t} \leqq \dot{t} \leqq$ current _time. At some point in time, detections which cannot be verified and which are limiting the updating of timing marker $\ddot{t}$ 348 or timing marker $\dot{t}$ 310, detection may be deleted go by the system operator. The duration of each extrapolation region 304 and 306 is related to the maximum detection time within which detections could possibly chain.] The duration of extrapolation regions 304*a*–304*n* and 306*a*–306*n* vary as a function of each specific detection, the roadway topology, and traffic conditions including, for example, traffic incidents. The duration of the extrapolation regions 304*a*–304*n* and 306*a*–306*n* are determined, for example, by the constraints of equation (5). In one embodiment, the determination of timing markers $\dot{t}$ 310 and $\ddot{t}$ 308 can be used to provide a means for batch processing a plurality of detections which are in one of several possible states, for example: (i) Not yet reported by the RTC; (ii)Verified by manual read; (iii) Being audited; (iv) Unknown verify state (also referred to as Need for Verification Undecided); and (v)Verification in progress.

When, for example, an extrapolation region 304*a* crosses the timing marker $\dot{t}$ 310, detection 318 cannot be determined to be the end of a trip because there might exist a detection (here detections 316 or 320) occurring later than timing marker $\dot{t}$ 310 which has not yet been verified/ audited and which might chain to detection 318.

Timing marker $\ddot{t}$ 308 is the detection time for the oldest detection in the system that has not been made available to trip processing or has not been evaluated for possible verification, or is in the process of being verified. Timing marker $\ddot{t}$ 308 is associated with step 142 in the process of FIG. 5. The plurality of detections located in time to the right of timing marker $\ddot{t}$ 308 cannot be used to form a firm trip because the state of a detection within this time frame can possibly change and therefore the detections would be excluded from forming a firm trip.

In operation, once timing markers $\dot{t}$ 310 and $\ddot{t}$ 308 are determined at some point in time, and each detection can be processed according to the detection position in time relative to timing markers $\dot{t}$ 310 and $\ddot{t}$ 308. In the sliding window embodiment, the constraints of equation (5) are used, for example, to process each detection. The sliding window embodiment includes simple processing rules, for example: do not process any detection to the right (later than) of $\dot{t}$ 310, here detection 320 is completely excluded from processing, and detections to the left of timing marker $\ddot{t}$ 308 and within regions 306*a*–306*n* have completed verification, if any was required. Detections 314, 322 and 332 can be evaluated to determine if they need to be verified because regions 304*b*, 304*c* and 304*d* end to the left of timing marker $\dot{t}$ 310.

In one embodiment a batch approach is used to process the vehicle detections. For example, at the start of each iteration of the steps in FIG. 5, the current $\dot{t}$ and $\ddot{t}$ are calculated and then used for processing detections during that iteration. On the next iteration, a new $\dot{t}$ and $\ddot{t}$ are calculated effectively sliding a moving window over the detections available for processing in the attempt to chain detections to form trips.

Now referring to FIG. 6B, a timing diagram 340 represents pass n+1 of the process as described in the flow diagram of FIG. 5. The timing diagram 340 includes timing marker $\dot{t}$ 346 and adjacent extrapolation region 342*a*–342*n* and timing marker $\ddot{t}$ 348 and adjacent extrapolation region 344*a*–344*n*. The timing diagram 340 includes a plurality detections 314'–332' which represent like detections of FIG. 6A as of time T' which is the current time at which pass n+1 is executed. A detection 322 (represented by a cross in FIG. 6A), for example, is represented as a triangle detection 322' because it has been single gateway verified and can be chained to detection 324' to potentially form a trip. Any detection to the right (recorded later in time) of timing marker $\ddot{t}$ 348 can potentially be associated with any earlier detection, for example, if a detection includes a video plate image which must be resolved with a manual plate read which has not occurred by timing marker $\ddot{t}$ 348. A firm trip can be formed by chaining detections 334', 336', and 338', for example, because extrapolation region 344*n* does not cross the timing marker $\ddot{t}$ 348, and therefore detection 338' can be determined to be the end of the trip because no verified or audited detection can occur which chains to detection 338'.

All publications and references cited herein are expressly incorporated herein by reference in their entirety.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

What is claimed is:

1. A method for determining a vehicle trip on a roadway, the method comprising:

providing a plurality of vehicle detections from a plurality of gateways;

determining a maximum travel time between corresponding pairs of the plurality of gateways;

correlating corresponding pairs of the plurality of vehicle detections by determining travel time between each of the gateways of each of the corresponding pairs of detections is less than a corresponding maximum travel time;

determining a plurality of chainable detections; and determining the boundaries of the trip.

2. The method of claim 1 wherein the providing the plurality of vehicle detections comprises providing at least one license plate image corresponding to one of the plurality of vehicle detections.

3. The method of claim 2 further comprising:

determining a vehicle license plate number; and processing the at least one license plate image for verifying the vehicle license plate number.

4. The method of claim 1 wherein the providing a plurality of vehicle detections comprises filtering a plurality of vehicle transactions for providing the plurality of vehicle detections.

5. The method of claim 4 wherein the plurality of vehicle transactions includes at least one ambiguous transaction; and further comprising eliminating at least one ambiguous transaction from the plurality of vehicle transactions.

6. The method of claim 5 wherein the at least one ambiguous transaction includes a conflicting gateway crossing.

7. The method of claim 4 further comprising eliminating dual transactions from the plurality of vehicle detections.

8. The method of claim 1 wherein the correlating the corresponding pairs of the plurality of vehicle detections further comprises determining whether each of the pair of detections is provided by a corresponding pair of gateways that are disposed logically consistent with the roadway topology.

9. The method of claim 1 wherein the correlating corresponding pairs of the plurality of vehicle detections further comprises determining that the travel time between each of the detections is greater than a minimum travel time.

10. The method of claim 1 wherein the determining a maximum travel time comprises determining an incident free maximum travel time.

11. The method of claim 10 further comprising:

determining an expected travel time; and determining that the maximum travel time is the longer of the expected travel time and the incident free maximum travel time.

12. The method of claim 11 further comprising:

detecting a traffic incident; and modifying the expected travel time in response to the traffic incident.

13. The method of claim 1 further comprising waiting for the plurality of chainable detections to be initially processed.

14. The method of claim 13 further comprising determining a latest time for the plurality of vehicle detections.

15. The method of claim 1 further comprising waiting for the plurality of chainable detections to be verified.

16. The method of claim 1 wherein the determining the boundaries comprises detecting the end of the trip.

17. The method of claim 16 wherein detecting the end of the trip comprises:

determining a maximum detection time for the plurality of chainable detections;

determining a current boundary time;

comparing the current boundary time to the maximum detection time; and declaring the end of the trip in response to determining that the current boundary time is greater than the maximum detection time.

18. The method of claim 1 wherein the determining the boundaries comprises detecting a start of the trip.

19. The method of claim 1 further comprising forming the trip by chaining the plurality of chainable detections.

20. The method of claim 1 further comprising waiting for the plurality of chainable detections to include all vehicle detections that might chain.

21. The method of claim 20 wherein the waiting for the plurality of chainable detections comprises:

determining a first time wherein each of the plurality of chainable detection has a extrapolation region terminating earlier than the first time.

22. The method of claim 21 further comprising:

determining a second time wherein each of the plurality of chainable detections occuring later than the first time has a second extrapolation region terminating earlier than the second time.

23. The method of claim 22 further including verifying a vehicle detection from among the plurality of vehicle detections occurring between the first and the second time using a video image of a license plate number captured at the time of the vehicle detection.

24. The method of claim 23 wherein the verifying a vehicle detection comprises automatically recognizing the license plate number from the video image.

25. The method of claim 23 wherein the verifying a vehicle detection comprises manually reading the license plate number from the video image.

26. The method of claim 1 wherein the plurality of vehicle detections is provided by at least one of:

an enforcement gateway; and a toll gateway sensor.

27. The method of claim 1 wherein each of the plurality of vehicle detections comprises:

a time of the detection; and the location of the detection.

28. The method of claim 1 wherein the determining the boundaries of the trip comprises using at least one of:

a traffic incident; and a set of billing policies.

29. A method for determining a vehicle trip on a roadway having a plurality of gateways disposed according to a roadway topology, the method comprising:

providing a model of the topology including gateway connectivity, a plurality of minimum travel times between pairs of gateways, and a plurality of incident free maximum travel times between pairs of gateways;

providing a plurality of vehicle detections;

providing a set of rules for applying the model;

correlating the plurality of vehicle detections by applying the rules to the plurality of vehicle detections; and determining a plurality of chainable vehicle detections forming the trip.

30. The method of claim 29 further comprising determining a plurality of expected travel times between the pairs of gateways.

31. The method of claim 30 further comprising chaining the plurality of chainable vehicle detections for forming a potential trip.

32. The method of claim 31 further comprising verifying a license plate reading corresponding to at least one of the plurality of chainable vehicle detections.

33. The method of claim 32 further comprising waiting for required verification of at least one of the plurality of chainable vehicle detections in the potential trip; and chaining the plurality of chainable vehicle detections to form the trip.

34. A toll collection system comprising:

a plurality of gateways;

a trip determination processor comprising:

a transaction processor;

a vehicle detection correlation processor coupled to the transaction processor and adapted to determine at least one of whether a travel time between pairs of gateways is less than a corresponding maximum travel time and whether a travel time between pairs of gateways is greater than a corresponding minimum travel time;

a transaction filter processor coupled to the vehicle detection correlation processor;

an end of a trip detection processor coupled to the transaction filter processor;

a start of a trip detection processor coupled to the transaction filter processor; and a trip formation processor coupled to the transaction filter processor, the end of a trip detection processor, and the start of a trip detection processor.

35. The system of claim 34 wherein the plurality of gateways is adapted for an open ticket tolling system.

36. The system of claim 34 wherein the plurality of gateways is adapted for a closed ticket tolling system.

37. The system of claim 34 wherein the plurality of gateways is adapted for an open ticket enforcement system.

38. The system of claim 34 wherein the plurality of gateways is adapted for a mixed open ticket, closed ticket tolling system.

* * * * *

UNITED STATES PATENT AND TRADEMARK OFFICE

CERTIFICATE OF CORRECTION

PATENT NO. : 6,922,156 B2
APPLICATION NO. : 10/058591
DATED : July 26, 2005
INVENTOR(S) : Kavner It is certified that error appears in the above-identified patent and that said Letters Patent is hereby corrected as shown below:

Column 1, line 29 delete "processors" and replace with --processor--.

Column 5, lines 43-45 delete "entitled Predictive Automatic Incident Detection Using Automatic Vehicle Identification filed" and replace with --entitled "Predictive Automatic Vehicle Detection Using Automatic Vehicle Identification," filed--.

Column 6, line 27 delete "is represent" and replace with --is represented--.

Column 7, line 15 delete "with method" and replace with --with methods--.

Column 7, line 23 delete "$n_{th}$" and replace with --$n^{th}$--.

Column 7, line 62 delete "$D_1$,i=1,...$N_k$," and replace with --$\{D_i, i = 1,\ldots,N_k\}$--.

Column 7, line 64 delete "$D_1$,=($g_1$,$t_1$)" and replace with --$D_i$ =($g_i$,$t_i$)--.

Column 7, line 65 delete "gateway $g_1$" and replace with --gateway $g_i$--.

Column 8, line 12 delete "order.)" and replace with --order.--.

Column 8, line 16 delete "$\rho(D_1,D_j)$" and replace with --$\rho(D_i,D_j)$--.

Column 8, line 24 delete "that $D_1$ and $D_j$" and replace with --that $D_i$ and $D_j$--.

Column 8, line 30 delete "Di" and replace with --$D_i$--.

Column 8, line 33 "$D_1 \rightarrow D_j$ if $\rho(D_1,D_j)$=1" and replace with --$D_i \rightarrow D_j$ if $\rho(D_i,D_j)$=1--.

Column 8, line 64 "($g_{i-1}$,$g_t$) and replace with --($g_{i-1}$,$g_i$)--.

Column 9, line 63 delete "step 142 FIG. 4)." and replace with --step 142, FIG. 4).--.

Column 10, line 14 delete "detection $D_1$ chains with $D_j$ if $D_1$ and $D_j$" and replace with --detection --detection $D_i$ chains with $D_j$ if $D_i$ and $D_j$ are--.

Column 11, line 1 delete "no not" and replace with --do not--.

Column 11, line 2 delete "situation" and replace with --situations--.

UNITED STATES PATENT AND TRADEMARK OFFICE

CERTIFICATE OF CORRECTION

PATENT NO. : 6,922,156 B2
APPLICATION NO. : 10/058591
DATED : July 26, 2005
INVENTOR(S) : Kavner It is certified that error appears in the above-identified patent and that said Letters Patent is hereby corrected as shown below:

Column 12, line 5 delete “In case” and replace with --In the case--.

Column 12, line 11 delete “if video image” and replace with --if the video image--.

Column 12, lines 23-24 delete “an “unreadable” plate processing” and replace with --an “unreadable” plate, processing--.

Column 12, lines 54-55 delete “entitled System And Method For Reading License Plates filed” and replace with --entitled “System And Method For Reading License Plates,” filed--.

Column 13, lines 14-15 delete “in step 144 and 126” and replace with --in steps 144 and 126.--.

Column 14, lines 15-16 delete “an “unreadable” plate processing” and replace with --an “unreadable” plate, processing--.

Column 15, line 29 delete “available processing” and replace with --available, processing--.

Column 15, line 52 delete “more transaction” and replace with --more transactions--.

Column 16, line 33 delete “”time difference”” and replace with --“Time difference”--.

Column 16, line 53 delete “being last” and replace with --being the last--.

Column 16, line 55 delete “being last” and replace with --being the last--.

Column 17, line 31 delete “at 242.” and replace with --at step 242.--.

Column 17, line 33 delete “at 242.” and replace with --at step 242.--.

Column 17, line 34 delete “at 252.” and replace with --at step 252.--.

Column 17, line 49 delete “at 242,” and replace with --at step 242,--.

Column 17, line 50 delete “at 258.” and replace with --at step 258.--.

Column 17, line 55 delete “, an alternatively” and replace with --, or alternatively,--.

UNITED STATES PATENT AND TRADEMARK OFFICE

CERTIFICATE OF CORRECTION

PATENT NO. : 6,922,156 B2
APPLICATION NO. : 10/058591
DATED : July 26, 2005
INVENTOR(S) : Kavner It is certified that error appears in the above-identified patent and that said Letters Patent is hereby corrected as shown below:

Column 17, line 63 delete "occurs the" and replace with --occurs when the--.

Column 18, line 52 delete "deleted go by" and replace with --deleted by--.

Column 18, line 55 delete "chain.]" and replace with --chain.--.

Column 19, line 18 delete ", and each" and replace with --, each--.

Column 19, line 42 delete "region 342a-342n" and replace with --regions 342a– 342n--.

Column 19, lines 43-44 delete "region 344a-344n" and replace with --regions 344a-344n.--.

Column 20, line 14 delete "determining travel time" and replace with --determining that a travel time--.

Column 21, line 26 delete "chainable detection has a extrapolation" and replace with --chainable detections has a first extrapolation--.

Signed and Sealed this

Third Day of June, 2008

JON W. DUDAS
*Director of the United States Patent and Trademark Office*